United States Patent [19]

Colletta et al.

[11] 4,165,220

[45] Aug. 21, 1979

[54] PROCESS FOR PRODUCING HARDENED SEMICOKE BRIQUETTES

[75] Inventors: Angelo Colletta; Paolo Marini, both of Rome, Italy

[73] Assignee: Centro Sperimentale Metallurgico S.p.A., Rome, Italy

[21] Appl. No.: 908,470

[22] Filed: May 22, 1978

Related U.S. Application Data

[63] Continuation-in-part of Ser. No. 817,919, Jul. 21, 1977, abandoned.

[30] Foreign Application Priority Data

Aug. 4, 1976 [IT] Italy ..... 50766 A/76

[51] Int. Cl.[2] ..... C10L 5/16; C10L 5/40

[52] U.S. Cl. ..... 44/23; 44/10 C; 201/5

[58] Field of Search ..... 44/19, 10 C, 10 J, 23; 201/5

[56] References Cited

U.S. PATENT DOCUMENTS

| | | | |
|---|---|---|---|
| 3,926,576 | 12/1975 | Schmalfeld et al. | 44/10 C |
| 3,969,088 | 7/1976 | Mansfield et al. | 44/10 C |
| 4,039,319 | 8/1977 | Schapiro et al. | 44/10 C |
| 4,050,990 | 9/1977 | Lorenz | 44/10 C |

*Primary Examiner*—Carl Dees

*Attorney, Agent, or Firm*—Young & Thompson

[57] ABSTRACT

Briquettes obtained from semicoke and a binder such as pitch, can be hardened when stacked to relatively great height of 5 to 10 meters, provided the "green" briquettes are heated in a vertical oven at a temperature between 300° C. and 400° C. for 35 to 50 minutes in an inert atmosphere such as nitrogen.

3 Claims, No Drawings

PROCESS FOR PRODUCING HARDENED SEMICOKE BRIQUETTES

This application is a continuation-in-part of our application Ser. No. 817,919, filed July 21, 1977 and now abandoned.

The present invention relates to the problem of hardening briquettes obtained from semicoke and a binder (e.g. pitch), without resorting to the system currently adopted which occupies a great deal of floor space, and of avoiding a high percentage of breakage which occurs in a multiple-layer stacking.

More precisely, the present invention provides a process for hardening briquettes characterized by the fact that it can be carried out in a vertical type of oven. Physical-chemical conditions have been found under which the briquettes unexpectedly do not suffer mechanical degradation when subjected to the weight of superposed layers of other briquettes.

In the traditional process, the briquettes are hardened by heating to a temperature of approximately 200° C. in the presence of an oxidizing atmosphere. Under these conditions, the oxygen promotes copolymerization of the binder (normally pitch) with the semicoked material and the baking effect of the temperature gives a uniform briquette in which the carbon yielded by the semicoked material and the carbon yielded by the binder are for all practical purposes indistinguishable.

For hardening, the "green" briquettes, stacked in a layer 30–45 cm. in height, are placed on a moving grate or on suitable racks which move through a tunnel furnace kept at approximately 200° C.; inside the furnace the briquettes are bathed by a gas stream containing from 5% to 18% by volume of oxygen.

Apart from the limitation of the layer height, this technique has several other drawbacks. In the first place, the equipment is costly and has a very high rate of wear; secondly, the equipment has a limited production capacity and occupies a great deal of floor space. The total time required for completing the treatment is about two hours or more, depending on the size of the briquettes.

To sum up, the problem of hardening briquettes was previously solved by adopting "tunnel" or "moving grate" furnaces in which the briquettes were heated to 200° C. and kept at that temperature in the presence of an air stream for two hours, or even longer, without being subjected to loads or exposed to the possibility of abrasion which would have led to high breakage.

The present invention eliminates the above limitations imposed on the height of the briquette bed. The invention is based on the discovery that "green" briquettes composed of semicoke and pitch (as a binder) can be hardened in a vertical oven without breakage provided that after stacking in the oven to a depth of about 5 to 10 meters, they are subjected to a preliminary heat treatment in a substantially inert atmosphere. It has been ascertained, in fact, that if the malleable "green" briquettes are heated to temperatures between 300° and 400° C. they become hard and tough to the point where they can be unloaded without damage from the oven after a period of time of about 35 to 50 minutes and even if still hot.

Although a height range of about 5 to 10 meters is recited above, it must be realized that the opposite ends of this range are not sharply defined. At the lower end, the minimum height is merely a matter of economics, it being obviously uneconomical to operate with a stack whose height is not close to the maximum height above which crushing of the lowermost briquettes occurs. At the upper end of the range, the briquettes can evidently be stacked as high as desired provided the lowermost briquettes are not crushed by the weight of the stack; but in this regard it is not safe to exceed about 10 meters.

The unloaded briquettes can then be subjected to appropriate standard high-temperature baking treatments depending on the use for which the briquettes are intended.

The temperature limits indicated above are critical. Operating at temperatures below 300° C. it was observed that the briquettes bulged with a slacking effect on the semicoke grains. At temperatures higher than 400° C., the power consumption increases without better results in comparison to those obtained according to the present invention.

When we speak of briquettes composed of semicoke and pitch, it is necessary to point out what we mean by "briquettes" and what we mean by "semicoke". In particular, when speaking of briquettes, we are not talking about pellets formed by tumbling. Instead, we are speaking of briquettes formed by high pressure rolling of semicoke and pitch between rolls that exert a pressure at the roll nip in a range between 2 and 6 tons per centimeter of the width of the strip of material passing between the rolls, measured in a direction parallel to the axis of the rolls.

Also, when speaking of "semicoke", we do not mean the char formed by relatively low temperature processes such as 760° C. or lower commonly used for the carbonization of char for the formation of pellets. Instead, we mean carbonization at a temperature of about 900° to 1000° C. for a period of time of about 5 to 45 minutes.

Examples of the formation of such briquettes, and more particularly the semicoke from which they are formed, are to be found in U.S. Pat. Nos. 4,056,443 and 4,108,731, the disclosure of which is incorporated herein by reference.

Following this general description of the process for hardening briquettes according to the present invention, an example is now given to illustrate more clearly the purpose, characteristics and advantages of the process without however implying any restrictions whatsoever to the scope of the invention.

EXAMPLE

A batch of "green" briquettes was prepared by mixing semicoke and pitch together for 15 minutes at 100° C. Semicoke had been formed as in the above-identified patent and application, the carbonization having been conducted at 950° C. for 15 minutes. The briquettes were formed by passing through a roll stand which applied to the rolled material at its nip a pressure of 4 tons per centimeter width of the material. The 36×42×25 mm briquettes containing 85% by weight of semicoke and 15% of pitch were then hardened according to the process of this invention. The briquettes were placed in a shaft oven heated to 360° C. to a depth of 5 meters and kept at that temperature (in a nitrogen atmosphere) for 50 minutes. The briquettes were then unloaded from the shaft furnace and passed to the baking plant, where they were heated for 15 minutes at a temperature of 900° C. After baking, the briquettes were found to have the following properties:

| | |
|---|---|
| Apparent density | 1.11 g/cm$^3$ |
| Actual density | 1.86 g/cm$^3$ |
| Porosity | 40.32% |
| Bulk density | 620 kg/m$^3$ |
| Compressive strength | 200 kg/briquette |
| MICUM Test (registered trademark) | $M_{20}$ = 86.6% $M_{10}$ = 10.2% |

The briquettes were subsequently treated according to standard techniques as required for their intended use.

What is claimed is:

1. Process for producing hardened semicoke briquettes, comprising forming "green" briquettes by admixing semicoke that has been carbonized at a temperature between about 900° and 1000° C. for 5 to 45 minutes, with pitch as a binder, passing the admixed semicoke and pitch through a rolling operation in which the admixed semicoke and pitch is subjected to a pressure between 2 and 6 tons per centimeter width of the admixed material, and heating the "green" briquettes in a vertical oven at a bed depth of about 5 to 10 meters at a temperature between 300° C. and 400° C. and for a time interval between 35 and 50 minutes.

2. Process as claimed in claim 1, in which said heating is carried out in a substantially inert atmosphere.

3. Process as claimed in claim 2, in which said inert atmosphere is nitrogen.

* * * * *